US006314345B1

(12) United States Patent
Coombes

(10) Patent No.: US 6,314,345 B1
(45) Date of Patent: Nov. 6, 2001

(54) LOCOMOTIVE REMOTE CONTROL SYSTEM

(75) Inventor: Ian Coombes, Wellington (NZ)

(73) Assignee: Tranz Rail Limited, Wellington (NZ)

( * ) Notice: Subject to any disclaimer, the term of this patent is extended or adjusted under 35 U.S.C. 154(b) by 0 days.

(21) Appl. No.: 09/463,463

(22) PCT Filed: Jul. 22, 1998

(86) PCT No.: PCT/NZ98/00111

§ 371 Date: Jul. 18, 2000

§ 102(e) Date: Jul. 18, 2000

(87) PCT Pub. No.: WO99/05015

PCT Pub. Date: Feb. 4, 1999

(30) Foreign Application Priority Data

Jul. 22, 1997 (NZ) ..... 328389

(51) Int. Cl.[7] ..... B60T 13/68

(52) U.S. Cl. ..... 701/19; 701/20; 701/70; 303/1; 246/187 A; 104/305

(58) Field of Search ..... 701/19, 20, 70; 303/1, 2, 3, 15, 13, 20; 104/307; 246/1 R, 187 A, 4; 340/901

(56) References Cited

U.S. PATENT DOCUMENTS 3,707,309 * 12/1972 Engle ..... 303/13
4,687,258 * 8/1987 Astley ..... 303/3
5,172,316 * 12/1992 Root et al. ..... 701/70
5,249,125 * 9/1993 Root et al. ..... 701/70
5,803,554 * 9/1998 Maruta et al. ..... 303/3
5,823,638 * 10/1998 Sich et al. ..... 303/22.1
5,954,780 * 9/1999 Jang ..... 701/93
6,059,075 * 5/2000 Saxton et al. ..... 188/107
6,114,974 * 9/2000 Halvorson .
6,135,396 * 10/2000 Whitfield et al. ..... 264/182 R

* cited by examiner

*Primary Examiner*—William A. Cuchlinski, Jr.
*Assistant Examiner*—Olga Hernandez
(74) *Attorney, Agent, or Firm*—Knobbe, Martens, Olson & Bear, LLP

(57) ABSTRACT

A connection unit is adapted to be connected to train line and brake line connectors of a locomotive as part of a remote control system for the locomotive. The connection unit includes a receiver for receiving remote control instructions, an interface for connection to the train line and brake line connectors, and a microprocessor. The microprocessor is arranged to determine the locomotive's configuration, interpret the received remote control instructions, modify said instructions dependent on the locomotive's configuration, and operate the interface such that the locomotive is controlled according to the locomotive configuration and the remote control instructions.

9 Claims, 3 Drawing Sheets

LOCOMOTIVE REMOTE CONTROL SYSTEM

BACKGROUND

Rail operators require both mainline locomotives for train haulage and shunt locomotives for shunting functions. Remote control locomotives which can be controlled away from the vehicle are advantageous for railyard shunting and are usually specially fitted out for remote operation. Manually controlled and remote control locomotives are often dedicated to their respective functions and cannot be interchanged without refitting.

U.S. Pat. No. 4,687,258, discloses a portable remote control system which includes a receiver unit which plugs into a locomotive's train line socket to control train line circuits. Some mainline locomotives are equipped with a "train line" (usually an electrical control signal interface) and brake control line (usually pneumatic airline interface) which enable one locomotive to be linked with another locomotive for multiple operation. The portable remote control system also includes pneumatic equipment for connection into the locomotive's pneumatic braking systems. The system bleeds air from the train air brake line to control the independent locomotive brakes. The bleed of air is limited so the small loss of air from the train air brake line does not apply the train brakes (which are normally operated by a reduction in air pressure). A transmitter unit remote from the locomotive allows an operator to send commands or control signals to the receiver unit which are then implemented by control of the train line circuits and braking systems. The system is dedicated to one specific type of train line socket and train line circuit arrangement as received commands are implemented directly by energising a corresponding relay. The system also acts as a slave to the transmitter commands, implementing the commands irrespective of whether they represent "safe" or otherwise allowable commands.

SUMMARY OF THE INVENTION

It is an object of the present invention to provide an improved or at least alternative locomotive remote control system.

In broad terms in one aspect the invention comprises a connection unit adapted to be connected to the train line and brake line connectors of a locomotive as part of a remote control system for the locomotive, the connection unit comprising:

- receiver means for receiving remote control instructions;
- interface means for connection to the train line and brake line connectors;
- and microprocessor means arranged to determine the locomotive's configuration, interpret the received remote control instructions, modify said instructions dependent on the locomotive's configuration, and operate the interface means such that the locomotive is controlled according to the locomotive configuration and the remote control instructions.

For the purposes of this specification, the locomotive's configuration refers to the type of locomotive and its operating systems which will vary from locomotive type to locomotive type. The locomotive's configuration may be identified directly by the microprocessor means through the interface means, or alternatively configuration information details may be manually entered into the microprocessor means through a further dedicated manual interface means.

Preferably the microprocessor means is arranged to monitor the locomotive's operating systems such that operation of the interface means further depends on the state of the operating systems. For example, upon receiving a brake release instruction, the microprocessor means may query whether the locomotive braking system has adequate air pressure before releasing the brakes.

Preferably the connection unit is portable and is directly connectable to the train line and brake line connectors. Preferably the connections are the same as those required for multiple operation for the locomotive. Preferably the connections are such that any locomotive designed to operate in multiple does not require any further modifications to interface with the connection unit.

Preferably the microprocessor means may be configured such that the interface means operation is further dependent on the locomotive's functional situation. For example, in certain shunting operations, the locomotive may be restricted to certain maximum speeds. The microprocessor means may also be configured to implement ramped or stepped throttle control, or to cancel the throttle before applying the braking system, for example.

Preferably the microprocessor means further includes fault logging and/or event recording facilities.

Preferably the microprocessor means is a programmable logic controller (PLC).

Preferably the connection unit further incorporates additional features for controlling locomotive systems not normally controlled through the train line or brake line connectors, for example locomotive lighting controls or horn.

Preferably the connection unit further incorporates additional features for controlling systems external to the locomotive, for example coal discharge sites, points operation, indicator lights, or doors.

In broad terms in another aspect the invention comprises a remote control system for a locomotive comprising:

- a remote controller means to transmit remote control instructions;
- a connection unit adapted to be connected to the train line and brake line connectors of the locomotive, the connection unit comprising:
  - a receiver means for receiving the remote control instructions;
  - interface means for connection to the train line and brake line connectors;
  - and microprocessor means arranged to determine the locomotive's configuration, interpret the remote control instructions, modify said instructions dependent on the locomotive's configuration, and operate the interface means such that the locomotive is controlled according to the locomotive configuration and the remote control instructions.

The invention provides a portable remote control system for locomotives which is easily connectable and adaptable to different locomotive configurations, and in addition only implements received commands if they are safe or meet other implementation criteria.

The invention provides full locomotive control by remote control within safe and otherwise allowable operating parameters for the particular locomotive and its functional requirements. For example there are no operator imposed restrictions on the system's capacity to apply or release brakes.

In broad terms in another aspect the invention comprises a method of remotely controlling a locomotive comprising:

- transmitting locomotive remote control instructions from a location remote from the locomotive;

receiving the locomotive remote control instructions at the locomotive;

identifying the locomotive configuration;

interpreting and modifying the received locomotive remote control instructions dependent on the locomotive configuration; and operating the locomotive according to the modified locomotive remote control instructions.

BRIEF DESCRIPTION OF THE DRAWINGS

A preferred embodiment of the remote control system of the invention will now be described, by way of example and without intending to be limiting, with reference to the accompanying drawings in which.

DESCRIPTION OF THE PREFERRED FORM

Figure 1:
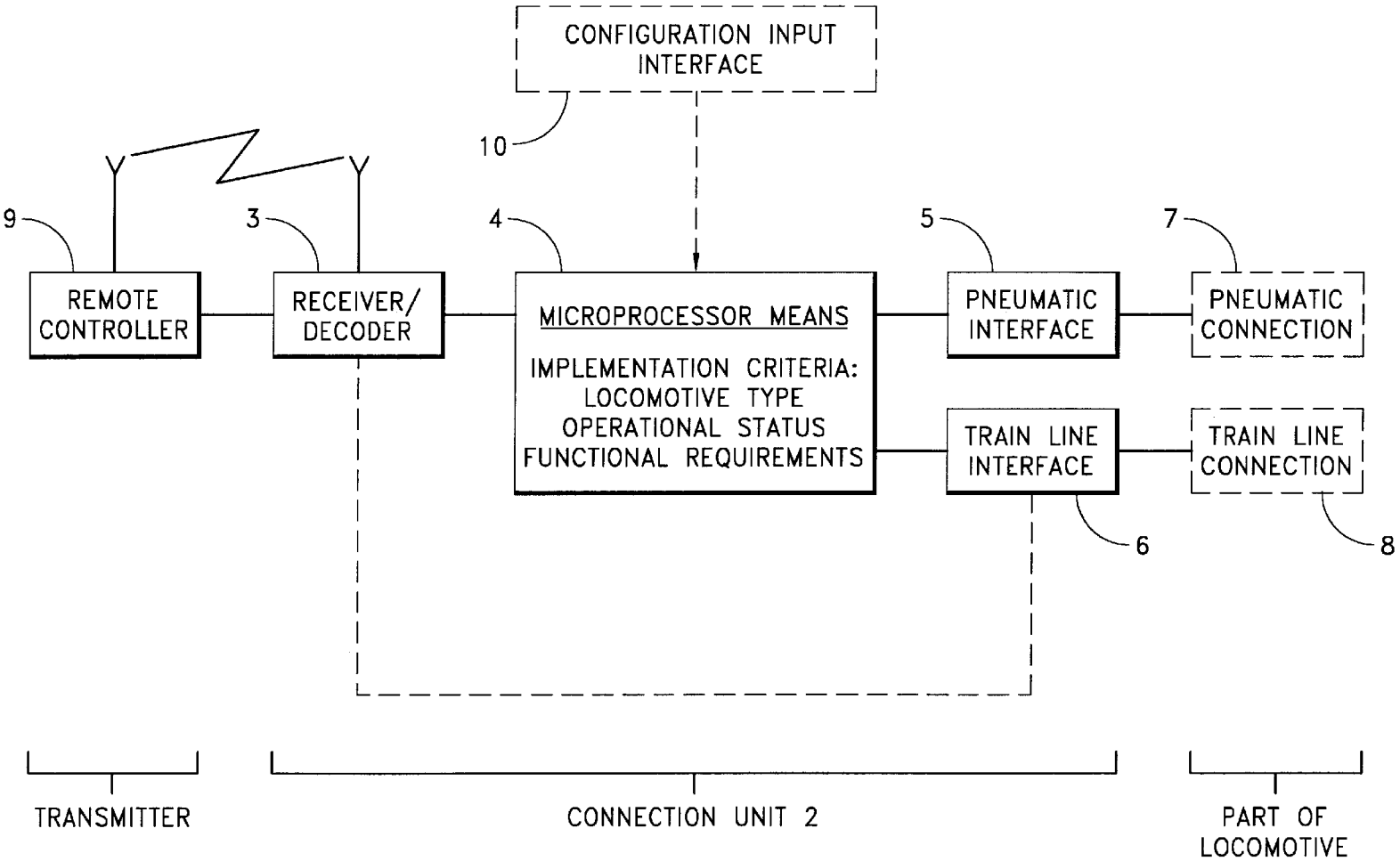
FIG. 1 is a schematic drawing of the preferred form system.

The preferred system shown in schematic form in FIG. 1 comprises a remote controller unit 9 in radio contact with a locomotive connection unit 2 comprising, a receiver/decoder unit 3, microprocessor means 4 including memory means, a pneumatic interface unit 5, and a train line interface unit 6. The connection unit 2 may optionally further comprise a locomotive configuration input interface 10.

Figure 2:
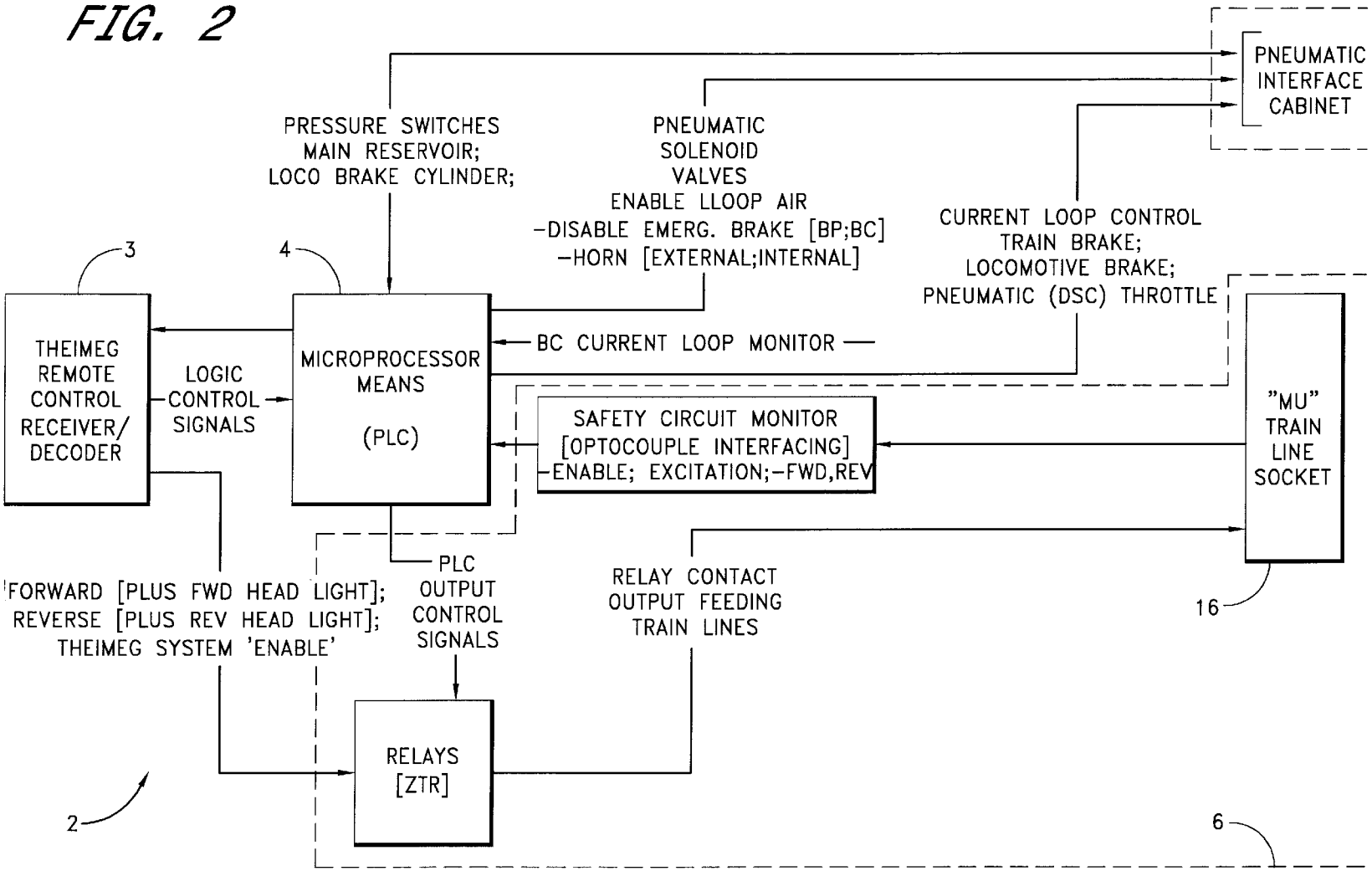
FIG. 2 is an electrical schematic diagram of the connection unit of the preferred form system.
Figure 3:
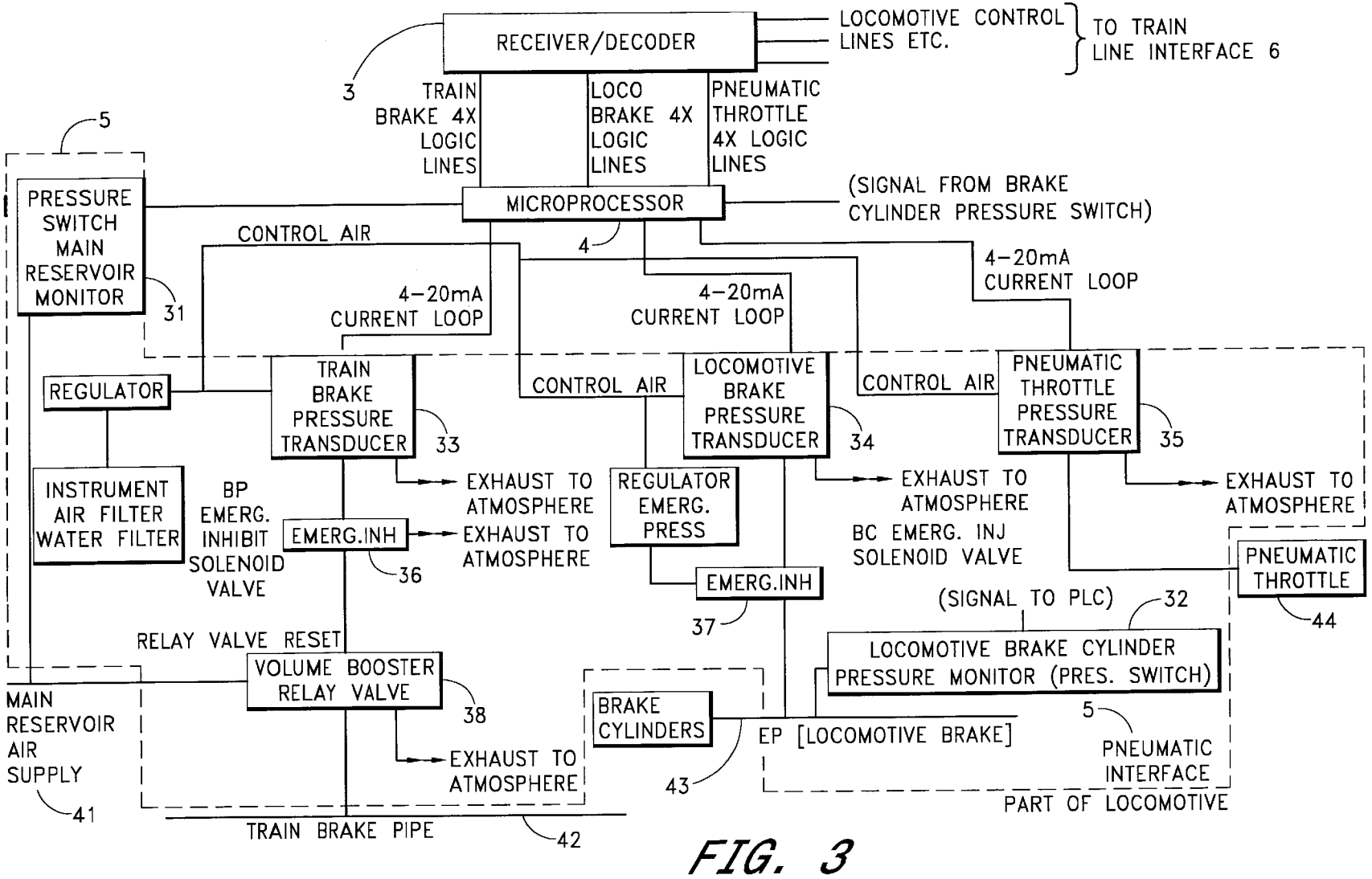
FIG. 3 is a pneumatic block diagram showing connections between the connection unit of the preferred form system and a locomotive's pneumatic systems.

The connection unit 2 is shown in more detail in FIGS. 2 and 3 and is installed in a locomotive using the pneumatic and train line interfaces 5 and 6. The interfaces 5 and 6 are adapted to allow both control and monitoring of locomotive operating Systems, including safety circuits or systems. Preferably the pneumatic and train line interface 5 and 6 connections are similar or equivalent to those used to connect the locomotive to another locomotive for multiple operation.

The train line interface 6 includes a train line plug or connector 16 which connects with a corresponding train line socket or connector 8 on the locomotive. The train line plug 16 may be configured to connect with train line sockets 8 of all locomotives used with the system, or adaptors (not shown) may be connected between the train line plug 16 and socket 8 to accommodate different socket 8 configurations. As a further alternative, the train line interface 6 may include a number of train line plugs 16, each with different configurations to connect with different train line sockets 8.

Locomotive operations such as throttle, direction and headline/marker light control for example, are achieved using relays connected into the appropriate train line circuit by the train line plug 16. Preferably the relays used are specialist rail vehicle miniature relays such as are manufactured by ZTR Controls, Canada, for example. Throttle control (where controlled by train line connection) is preferably implemented by operating relay contacts in a sequence compliant with the level of throttle commanded. Other switching arrangements or control systems could alternatively be used.

The locomotive's operating status as well as safety circuits are monitored via the train line plug 16 connections or contacts. For example the locomotive's alarm circuits and control circuits can be interrogated via these connections. Preferably, the connections are opto-couple connections.

The pneumatic interface 5 is shown in block diagram form in FIG. 3 and includes connections as shown to the locomotive's pneumatic systems including the locomotive main reservoir air supply 41, the train brake line 42, the locomotive brake line 43, ancillary systems such as the horn (not shown), and if used the pneumatic throttle 44. Adaptors (not shown) may be used to connect the locomotive pneumatic systems to the pneumatic interface 5.

The pneumatic interface 5 comprises a locomotive main reservoir air supply pressure switch 31, a locomotive brake line pressure switch 32, a train brake pressure transducer 33, a locomotive brake pressure transducer 34, a train brake volume booster 38, a train brake emergency solenoid valve 36, a locomotive brake emergency solenoid valve 37, and ancillary control air regulators and filters as shown. The interface 5 also includes a pneumatic throttle pressure transducer 35 for locomotives utilising a pneumatically controlled throttle. The pressure transducers 33, 34 and 35 are preferably current loop controlled.

The pneumatic interface 5 may also include additional pneumatic solenoid valves (not shown) to control for example, the supply of air to the horn and other miscellaneous pneumatic equipment. The interface 5 may also include an integral horn.

The locomotive main reservoir air supply 41 is connected to the locomotive main reservoir air supply pressure switch 31, which monitors the reservoir pressure, and to the pneumatic interface 5 control air system.

The locomotive main reservoir air supply 41 is also connected to the input of the train brake volume booster 38. The train brake line 42 is connected to the output of the train brake volume booster 38 which is controlled by the train brake pressure transducer 33 via the train brake emergency solenoid valve 36. The train brake is applied by a reduction in pressure in the train brake line 42. In an emergency braking situation, this can be achieved by control of the train brake pressure transducer 33 to control the train brake volume booster 38, or by operation of the train brake emergency solenoid valve 36.

The volume booster 38 is typically employed for train brake control and has its signal pressure sourced from the train brake pressure transducer 33 when high volume air control is required.

The locomotive brake line 43 is connected to the locomotive brake pressure switch 32 which monitors the locomotive brake line pressure. The locomotive brake line 43 is also connected to the locomotive brake pressure transducer 34 via the locomotive brake emergency solenoid valve 37. The locomotive brake is applied by an increase in pressure in the locomotive brake line 43. In an emergency braking situation, this can be achieved by control of the locomotive brake pressure transducer 34 and/or the locomotive brake emergency solenoid valve 37.

The system provides two independent methods of braking control (the train and locomotive braking systems), each with pressure transducer control (33 and 34 respectively). Upon an emergency braking situation, all pressure transducers are set to emergency braking pressure. The train brake volume booster 38 (where used) is exhausted to atmosphere by the train brake pressure transducer 33 or the train brake emergency solenoid valve 36. The locomotive brake has emergency brake pressure applied through locomotive brake pressure transducer 34 or the locomotive brake emergency solenoid valve 37.

Preferably the pressure transducers provide a maintaining brake system using a feedback arrangement to maintain a required pressure level. Selected pressure levels are repeatable and are controlled by the microprocessor means 4 and the current loop control method. Pressure levels depend on remote control instructions as conditioned by the microprocessor means 4 for the type of locomotive and the locomotive's functional requirements.

The system is configured to be fail-safe such that if a fault or failure occurs in either the remote control system (including the remote controller 9 and the connection unit 2) or is detectable on the locomotive itself, the system is configured to apply the emergency braking system for example. The system is preferably configured such that each brake system (locomotive and train) is independently fail-safe.

The system is typically configured to connect with locomotives using Westinghouse 26L pneumatic braking systems or similar.

The system can also be configured to control a locomotive where only a single braking system is required (typically the locomotive brakes).

The remote controller 9 is operated by an operator to remotely control the locomotive. The controller 9 transmits encoded signals to the connection unit 2 corresponding to the operator's commands. The controller 9 is required to be in constant radio contact with the connection unit 2, which is configured, for example, to apply the emergency braking system if radio contact is lost.

The receiver/decoder 3 of the connection unit 2 receives and decodes the encoded signals transmitted by the controller 9. The receiver/decoder 3 output logic or control signals are dependent on the operator's commands as entered into the remote controller 9.

The controller 9 and receiver/decoder 3 may be standard units manufactured by Theimneg Elektronikgerate GmbH & Co, Germany.

The microprocessor means 4 includes memory means and may be implemented as a Programmable Logic Controller operating according to a logic program. The microprocessor means 4 is programmed to implement the non-locomotive specific commands of the receiver/decoder output by controlling appropriate train line 5 and/or pneumatic 6 interface connections depending on the specific locomotive type, to operate the specific locomotive as commanded. The received commands will only be implemented if they are allowable and "safe" for the specific locomotive type and its selected functional requirements.

The microprocessor means 4 monitors the operating status and safety circuits of the locomotive to ensure that requested commands if implemented, will result in safe operation of the locomotive. For example, a command to release the emergency braking system will only be implemented if the locomotive main reservoir air supply 41 contains sufficient air to reapply the locomotive braking system 43. As a further example, the microprocessor means 4 may only implement an increase throttle command if the locomotive is below a pre-determined maximum speed limit. As a further example, the microprocessor means 4 may only institute a change in direction if adequate locomotive brakes 43 are applied.

The system may also be constructed and configured such that the connection unit 2 sends operating and safety system status signals back to the controller 9, for example to indicate why a throttle command hasn't been implemented.

The microprocessor means 4 may be configured to determine the locomotive type from the current connection arrangement of the pneumatic and train line interfaces. Alternatively, the locomotive type may be manually entered using a dedicated input interface 10.

The microprocessor means 4 contains a "database" which includes a set of locomotive types to be used with the system together with a list of operating parameters for each locomotive type. The parameters include allowable commands, safety ranges such as minimum-safe level of locomotive brake air pressure required before brake release is allowable, whether the locomotive throttle is pneumatically or train line controlled, as well as the particular connection arrangements required, such as which relay will be controlling which train line circuit after the train line plug 16 is connected to the train line connector 8.

The database also includes a set of commands corresponding to the receiver/decoder 3 output signals, for example a throttle forward command or a switch marker light on/off command. The microprocessor means 4 compares the received commands with the locomotive's operating parameters as well as the current operating status of the locomotive to determine whether they are allowable commands. If allowable, the microprocessor means 4 implements the commands by appropriate control of the pneumatic 5 interface and the train line plug 16.

The database also includes the locomotive's current selected functional requirements which further conditions the received commands by only allowing commands appropriate to the selected functional requirements. Special functional requirements may also be selected using the configuration input interface 10.

The connection unit 2 can be embodied in several ways to implement allowable received commands. The microprocessor means 4 may directly monitor the received commands via the receiver/decoder 3 output and, if allowable, implement the command by directly controlling the appropriate relay or other interface 5 or 6 element according to the locomotive type.

Alternatively, the receiver/decoder 3 outputs may be used to directly control interface 5 or 6 elements, for example the relays of the train line interface 5 as shown in FIG. 2. In this embodiment, the microprocessor means 4 enables or disables the relay or relays to be controlled by the receiver/decoder 3, depending on the locomotive type and whether the commands are allowable for safety or other reasons. For example, the microprocessor means 4 may enable one of a series of throttle relays which is appropriate to the specific locomotive to which the connection unit 2 is connected. All throttle relays may receive the receiver/decoder 3 throttle signal, however only the relay appropriate to the particular locomotive is enabled by the microprocessor means 4. The enabling of this relay will also further depend on the operating status and parameters of the locomotive as outlined above.

Preferably the microprocessor means 4 is implemented using a programmable logic controller (PLC) operating according to a logic program which incorporates the above mentioned database parameters.

Preferably the microprocessor means 4 includes fault logging and event recording capacity.

Preferably the system is contained in one or more "suitcase" size enclosures to facilitate portability.

The system may be enhanced to include automated train movements or multiple controls upon receipt of a single command. For example, the system may be configured to follow sequences such as release brakes, apply permitted throttle (for permitted speed) and travel a predefined route, reduce throttle and reapply brakes.

As a further alternative, the system may be incorporated into a larger remote control regime for multiple locomotives in a railyard for example, each locomotive being remotely controlled by an overall controller which co-ordinates their movements.

As well as multiple operation capable locomotives, the system can also be configured to connect to locomotives without this capacity, but which have been modified to allow access to and control of their braking and throttle systems.

The microprocessor means 4 provides versatility for additional features or changes in functionality to be introduced. For example, the system may be configured to control remote packs located within the train to perform overriding braking functions on selected vehicles. As a further example, the microprocessor means 4 may be configured to enable inter-system communications using for example RS485 overlaid on dedicated or otherwise occupied train line wiring.

The foregoing describes the invention including preferred forms thereof. Alterations and modifications as will be obvious to those skilled in the art are intended to be incorporated within the scope hereof

What is claimed is:

1. A connection unit adapted to be connected to train line and brake line connectors of a locomotive as part of a remote control system for the locomotive, the connection unit comprising:

receiver means for receiving remote control instructions;

interface means for connecting the connection unit to the train line and brake line connectors; and microprocessor means arranged to determine the locomotive's configuration, interpret the received remote control instructions, modify said instructions dependent on the locomotive's configuration, and send instructions to the interface means such that the locomotive is controlled according to the locomotive configuration and the remote control instructions.

2. A connection unit according to claim 1 wherein said receiver means comprises a radio receiver for receiving said remote control instructions by radio.

3. A connection unit according to claim 1 wherein said interface means comprises a pneumatic interface unit and a train line interface unit.

4. A connection unit according to claim 3 wherein the pneumatic interface unit comprises a plug configured to connect to a multiple number of train line sockets or a multiple number of plugs each for connection to a different type of train line socket.

5. A connection unit according to claim 3 wherein the pneumatic interface unit comprises a locomotive main reservoir air supply pressure switch, a locomotive break line pressure switch, a train brake pressure transducer, a locomotive brake pressure transducer, and optionally a pneumatic throttle pressure transducer.

6. A connection unit according to claim 1 wherein the microprocessor means contains a data base of instruction information for a multiple number of locomotive types.

7. A remote control system for a locomotive comprising a connection unit adapted to be connected to train line and brake line connectors of a locomotive according to claim 1 and a remote control means operable by a user to transmit remote control instructions to the connection unit.

8. A method of remotely controlling a locomotive comprising:

transmitting locomotive remote control instructions from a location remote from the locomotive;

receiving the locomotive remote control instructions at the locomotive;

identifying the locomotive configuration;

interpreting and modifying the received locomotive remote control instructions dependent on the locomotive configuration; and operating the locomotive according to the modified locomotive remote control instructions.

9. A remote control system for a locomotive comprising a connection unit adapted to be connected to train line and brake line connectors of a locomotive and a remote control device operable by a user to transmit remote control instructions to the connection unit, the connection unit comprising:

a receiver adapted to receive remote control instructions;

an interface configured to connect the connection unit to the train line and brake line connectors; and a microprocessor arranged to determine the locomotive's configuration, interpret the received remote control instructions, modify said instructions dependent on the locomotive's configuration, and send instructions to the interface such that the locomotive is controlled according to the locomotive configuration and the remote control instructions.

* * * * *